US006399868B1

(12) United States Patent
Yamato et al.

(10) Patent No.: US 6,399,868 B1
(45) Date of Patent: Jun. 4, 2002

(54) SOUND EFFECT GENERATOR AND AUDIO SYSTEM

(75) Inventors: Makoto Yamato, Osaka (JP); Tony Williams, Hillsboro, OR (US)

(73) Assignee: Roland Corporation, Osaka (JP)

( * ) Notice: Subject to any disclaimer, the term of this patent is extended or adjusted under 35 U.S.C. 154(b) by 0 days.

(21) Appl. No.: 09/670,886

(22) Filed: Sep. 28, 2000

(51) Int. Cl.[7] ..... G10H 1/02

(52) U.S. Cl. ..... 84/701; 84/707; 84/DIG. 1; 84/DIG. 26; 84/DIG. 27

(58) Field of Search ..... 84/626–633, 662–665, 84/701–711, 737–741, DIG. 1, DIG. 26, DIG. 27; 381/61–65, 118

(56) References Cited

U.S. PATENT DOCUMENTS 3,007,361 A * 11/1961 Wayne ..... 84/DIG. 1
5,543,579 A * 8/1996 Morinaga et al. ..... 84/701
5,999,630 A * 12/1999 Iwamatsu ..... 84/DIG. 26

* cited by examiner

*Primary Examiner*—Stanley J. Witkowski
(74) *Attorney, Agent, or Firm*—Foley & Lardner

(57) ABSTRACT

A sound field effect adding apparatus is provided to add such effects as reverberation to the musical tone signal of an electronic organ and the like, and to produce a sound field effect. It is possible to create a satisfactory reproduced sound field to which a sound field effect has been added by means of a low frequency component without having to provide a dedicated unit or dedicated speaker system that can reproduce low frequencies. The apparatus has an input terminal with which a musical tone that includes a low frequency is input, and a means in which a sound field added musical tone signal is generated that produces a sound field effect that is based on an input musical tone signal. The apparatus has a first output terminal with which this sound field added musical tone signal is output to a speaker system used for sound field reproduction, and a generation means in which a low frequency component of the sound field added musical tone signal that contributes to the production of the sound field effect that is related to the low frequency is generated, which is different from the sound field added musical tone signal that is output by the first output terminal. The apparatus also includes a second output terminal with which this low frequency component is output to an external device.

9 Claims, 2 Drawing Sheets

SOUND EFFECT GENERATOR AND AUDIO SYSTEM

BACKGROUND OF THE INVENTION

1. Field of the Invention

Embodiments of the present invention relate to a sound field effect adding apparatus and process which is used with an electronic musical instrument such as, for example, an electronic organ that is equipped with a speaker system that can reproduce the low frequencies, where reverberation and the like are added to the musical tone signal of the electronic organ to produce a sound field effect. Further embodiments of the invention relate to an audio system in which such a sound field effect adding apparatus is employed.

2. Description of Related Art

A sound field effect adding apparatus is a device with which, by the addition of the indirect sounds to so called direct sounds, produces a sound field that approximates the presence of a performance venue. The direct sound may be produced by a musical instrument, such as an electronic organ. The indirect sound may include sound reflected by, for example, the walls and ceiling of the performance venue. A sound field effect adding apparatus may produce a sound field that accounts for such things as the arrangements of each of the musical instruments in the performance venue and the characteristics of the audio space of the performance.

By using, for example, three-dimensional stereo image orientation technology and also adding directional information for three-dimensional space, the production of a sound field that has more presence is realized. Normally, in the creation of a reproduced sound field that has presence, a multichannel speaker system (in general, a speaker system on the left and right and/or the rear and the front) is included in or connected to the instrument or system from which the musical tone signals are emitted.

Some electronic musical instruments such as electronic organs can produce musical tone signals in the low frequency range (for example, the audio band of around 100 Hz or less). Typically, such instruments, when used in a performance venue, are set up with or connected to a speaker system that includes speakers capable of producing the entire audio band, including low frequency tones and, by this means, it is possible to have good quality audio reproduction of the musical tones.

Because of this, in order to create a satisfactory reproduced sound field with a sound field effect adding apparatus, the speaker system for the sound field effect adding apparatus must be capable of reproducing the relevant low frequencies. Therefore, it is desirable to provide a speaker system that can reproduce the low frequencies for each channel in the same manner as the low frequencies can be reproduced with the above-mentioned multichannel speaker system. Alternatively, it may be necessary to provide a dedicated speaker system (woofers and the like) for the reproduction of the low frequencies that is separate from the above-mentioned multichannel speaker system. However, a speaker system for the reproduction of the relevant low frequencies can be relatively expensive.

SUMMARY OF THE DISCLOSURE

In consideration of the above noted problems, one aspect of preferred embodiments of the present invention is to make it possible to create a satisfactory reproduced sound field that has had a sound field effect with a low frequency component added, where the speaker system that has been installed in the electronic musical instrument is used as the speaker system for the production of the sound field. In this manner, a dedicated speaker system that can reproduce the low frequency tones is not necessary and, preferably, is not employed as the speaker system for the production of the sound field.

A sound field effect adding apparatus according to an embodiment of the present invention is equipped with an input terminal with which a musical tone of an audio band that includes a low frequency is input. The apparatus further includes a first generation means in which a sound field added musical tone signal is generated in order to produce a sound field effect that is based on a musical tone signal that has been input from the input terminal. The apparatus also includes a first output terminal for the output of the sound field added musical tone signal that has been generated in the first generation means to a speaker system used for sound field reproduction. The apparatus is provided with a second generation means in which a low frequency component of the sound field added musical tone signal that contributes to the production of a low frequency sound field effect is generated, where the low frequency component is different from the sound field added musical tone signal that is output by the first output terminal. The apparatus includes a second output terminal with which the low frequency component that has been generated in the second generation means is output to an external device.

A sound field effect adding apparatus, according to embodiments of the invention, may be provided with an output setting means in which the sound field added musical tone signal that has been output to a front speaker system (from among the speaker systems used for the above-mentioned sound field generation) is added to the low frequency component that has been generated in said second generation means and is output from said second output terminal to an external device.

Further embodiments relate to an audio system for use with an electronic musical instrument. In such embodiments, the audio system is configured using the above-mentioned sound field effect adding apparatus and, in preferred embodiments, also includes an electronic musical instrument that is provided with or connected to a speaker system for audio reproduction of audio tones across the audio band, including the low frequency tones. The audio system is configured so that the musical tone signal that is generated by the electronic musical instrument is supplied to an input terminal of the sound field effect adding apparatus. The sound field added musical tone signal that is output from the first output terminal of the sound field effect adding apparatus is supplied to said speaker system used for the production of the sound field, while the output signal that, is output from the second output terminal is supplied to said electronic musical instrument and emitted by the speaker system with which said electronic musical instrument is equipped.

By this means, since the portion of the sound field effect that is produced due to the contribution of the low frequency component is produced by the speaker system of the electronic musical instrument, there is no need to have the speaker system used for the production of the sound field provided with a low frequency reproduction capabilities. In this manner, the low frequency component is emitted only by the electronic musical instrument. However, since, in general, listeners are not very cognizant of the stereo position of low frequency tones, it is possible to fully provide the listeners with a good sound field effect.

Typically, the electronic musical instrument is arranged on a stage in front of the listeners and a speaker system used to produce the sound field is arranged behind the listeners as the rear speaker system. However, an additional front speaker system may also be provided. In the case of an audio system that is not equipped with a front speaker system, the sound field added musical tone signal that would otherwise be supplied to the front speaker system has the above-mentioned low frequency component added by the output setting means and is output to the electronic musical instrument. Thus, the speaker system of the electronic musical instrument can serve double duty as the front speaker system for the sound field production.

BRIEF DESCRIPTION OF THE DRAWINGS

The present invention will become more fully understood from the detailed description given herein below and the accompanying drawings, which are given by way of illustration only, and thus are not limitative of the present invention, and wherein.

DETAILED DESCRIPTION OF PREFERRED EMBODIMENTS

In the following description of preferred embodiments, reference is made to the accompanying drawings which form a part hereof, and in which is shown by way of illustration specific embodiments in which the invention may be practiced. It is to be understood that other embodiments may be utilized and structural changes may be made without departing from the scope of the preferred embodiments of the present invention.

Figure 1:
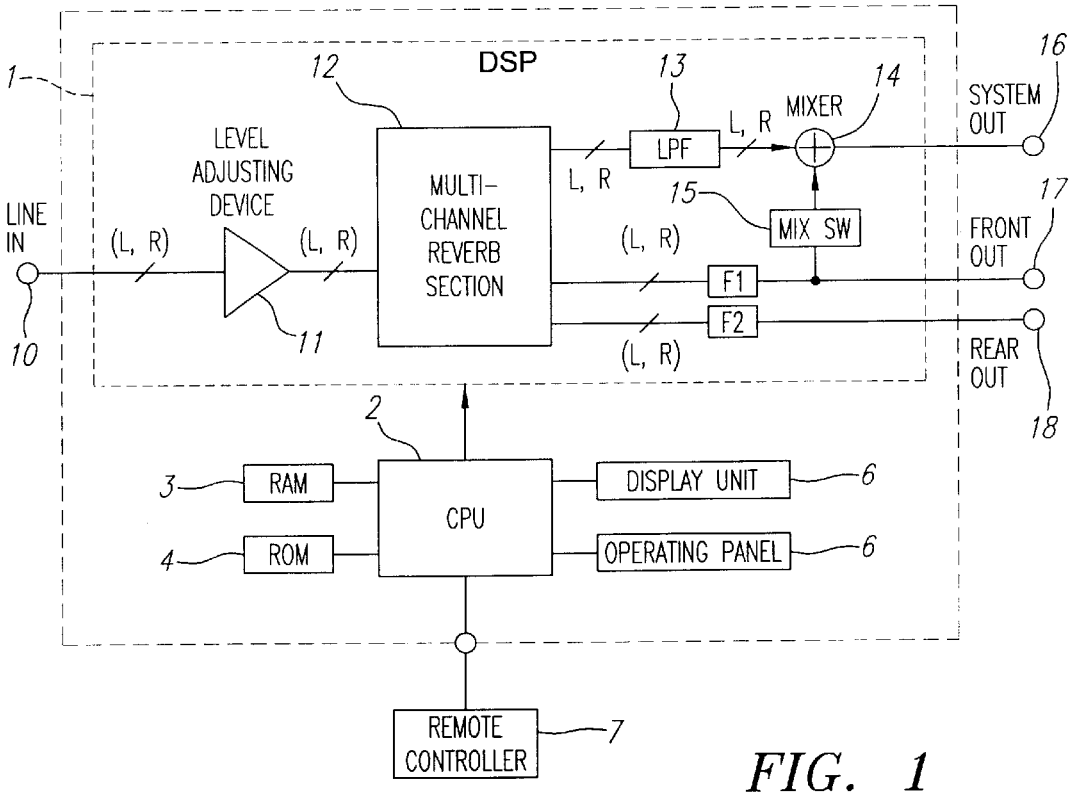
FIG. 1 is a block diagram of a sound field effect adding apparatus according to one preferred embodiment of the present invention.

FIG. 1 shows a sound field effect adding apparatus (also referred to as an ambience processor unit) according to one preferred embodiment of the present invention. In the FIG. 1 embodiment, a musical tone signal is input from an electronic organ, which is the electronic musical instrument in that embodiment. In addition, a sound field added musical tone signal, in which a sound field effect has been added to the musical tone signal based on the musical tone signal, is generated. This sound field added signal is supplied to a multichannel speaker system for sound reproduction, where the speaker systems includes. right and left speakers, in the front and the rear. In preferred embodiments of the present invention, the low frequency component of the sound field added musical tone signal is generated and supplied to the musical instrument (the electronic organ in the illustrated embodiment) from the system output terminal separately from the sound field added musical tone signal that is supplied to the multichannel speaker system.

Figure 2:
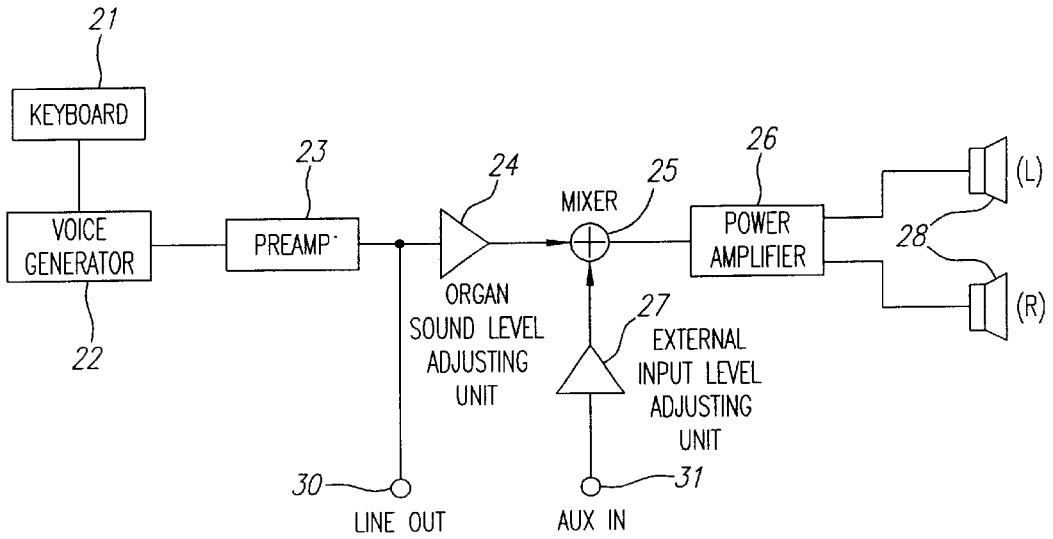
FIG. 2 is a block diagram of an electronic organ as an example of an electronic musical instruments t which a sound field effect adding apparatus according to a preferred embodiment is applied.

FIG. 2 shows a block diagram of an electronic organ. In FIG. 2, the organ includes a keyboard 21, a voice generator (the sound source) 22, a preamplifier 23, an organ sound level adjusting device 24, a mixer 25, a power amplifier 26, an external input level adjusting device 27, and left and right speaker systems 28.

In the FIG. 2 embodiment, the keyboard 21 is the operator with which the performance operation is accomplished, and the voice generator 22 is a sound source device with which the stereo musical tone signals are generated in conformance with the performance operation of the keyboard 21. In the drawing, all of the sign al paths from the voice generator 22 to the power amplifier 26 are drawn as a single line for simplification of the drawing. However, in preferred embodiments, all of the signal lines are implemented as ones with which stereo signals are output for the musical tone signals.

The preamplifier 23 is a preamplifying device with which the musical tone signals that are output from the voice generator 22 are preamplified. The output signal from the preamplifier 23 is output to an external device through the output terminal (Line Out) 30 and is also provided to the organ sound level adjusting device 24. The musical tone signal that has been output from the output terminal 30 is input to the input terminal 10 of the sound field effect adding apparatus embodiment of FIG. 1.

The organ sound level adjusting device 24 is a multiplier with which the signal level of a musical tone signal that has been output from the preamp 23 is controlled. In addition, the external input level adjusting device 27 is a multiplier with which the level of the external input signal that has been input from the external input terminal (Aux In) 31 is controlled. This external input signal is supplied from the system output terminal 16 of the sound field effect adding apparatus embodiment of FIG. 1.

The mixer 25 is an adder with which the musical tone signals of the organ sounds that have passed through the organ sound level adjusting device 24 and the external input signals that have passed through the external input level adjusting device 27 are added and output. The output of the mixer 25 is coupled to the input of the power amplifier 26.

The power amplifier 26 is an electrical amplifier for the emission of a level controlled musical tone signal from the rear level speaker systems 28. The speaker system 28 is a stereo speaker system for the audio conversion and emission of the musical tone signal and possesses characteristics such that it can reproduce, as audio, the musical tones across the entire sound range including low frequencies (which, in this preferred embodiment, comprises the audio band around 100 Hz and below).

With reference to FIG. 1, the following explanation relates to the structure of the illustrated sound field effect adding apparatus embodiment. The FIG. 1 embodiment includes a digital signal processor (DSP) 1 with which the musical tone signal that has been input from the input terminal 10 is processed in accordance with the parameters that are supplied by the central processing unit (CPU) 2. The DSP produces a musical tone signal that has had a sound field effect added.

Functions of the DSP 1 are shown by the functional blocks and comprise the input terminal 10, an input level adjusting device 11, a multichannel reverb section 12, a low-band-pass filter 13, a mixer 14, a mixer switch 15, a system output terminal 16, a front output terminal 17, a rear output terminal 18, etc. While the signal line that is in the DSP 1 is shown as a single line in the drawing, these signals are output as stereo signals with left and right channels.

As described above, the musical tone signals that have been output from the line output terminal 30 of the electronic organ are input to the input terminal 10. The input level adjusting device 11 is a multiplier with which the level of the musical tone signal that has been input from the input terminal 10 is controlled. The multichannel reverb section 12 is a processing unit with which, such components as the primary reflected sound, the reverberations, etc., and the directional data in three-dimensional space are added to the musical tone signal that has been input, the sound field effect is created and a sound field effect added musical tone signal is produced.

Here, the term sound field effect is taken to mean the creation and output of a sound field that has a feeling of presence in a performance venue, such as one would perceive if actually in the performance venue. Such presence is created by producing such components as the indirect sounds from directions in three dimensions, for example, from the walls and ceilings, in addition to the direct sounds from the stage in the performance venue, etc. (such as the primary reflections that follow the direct sounds and the reverberations that follow them) and the directional data in three-dimensional space with a signal delay system or the like and adding the components to the musical tone signal.

The sound field added musical tone signal for the front that has been generated by the multichannel reverb section 12 and is supplied to the front speaker system is output to the front output terminal 17. The sound field added musical tone signal for the rear that is supplied to the rear speaker system is output to the rear. output terminal 18. In addition, by passing the sound field added musical tone signal through the low-band-pass filter 13, the low frequency component that contributes to the creation of the sound field effect is extracted from the sound field added musical tone signal. This low frequency component is output to an external device (the external input terminal 31 of the electronic organ, in the illustrated embodiment) from the system output terminal (System Out) 16, via the mixer 14.

The low-band-pass filter 13 is a filter circuit with which the low frequency component (for example, of. 100 Hz or below) is extracted from the multichannel sound field added musical tone signal of the multichannel reverb section 12, and its cutoff frequency (for example, above 100 Hz) can be set appropriately by means of the operators on the operator panel 5. In preferred embodiments, the low frequency component may be extracted from the sum of the front and rear outputs of a multichannel sound field added musical tone signal.

In addition, for the sound field added musical tone signal that is input to the low-band-pass filter 13, the added composite of, for example, the sound field added musical tone signals for the front speaker system and the rear speaker system may be utilized or only the sound field added musical tone signal for the rear speaker system may be utilized. Alternatively, the apparatus may be set up so that an operation is carried out to create a sound field effect and generate a sound field added musical tone signal that is separate from the front and rear sound field added musical tone signals.

The mixer switch 15 is a switch which sets and determines whether or not the sound field added musical tone signal that is output to the front output terminal 17 for the front speaker system is to be added to low frequency component from the low-band-pass filter 13 in the mixer 14. In the illustrated embodiment, the mixer switch 15 is set so that it is ON in the case where the audio system that is employed (such as that shown in FIG. 3) is configured with only rear speakers as the multichannel speaker system and does not have front speakers. In that case, the signal that is output from the system output terminal 16 is a composite value of the low frequency component and the front sound field added musical tone signal. On the other hand, in the case where an audio system is employed (such as that shown in FIG. 4) that has speakers for the sound field generation in the front and the rear for the multichannel speaker system, the mixer switch 15 is set so that it is OFF. When the mixer switch 15 is OFF, only the signal that is output from the system output terminal 16 is provided for the low frequency component in the sound field added musical tone signal.

The CPU 2 controls the processing of the DSP 1 in accordance with the program that has been stored in the ROM 4. The RAM 3 is the working memory for the CPU processing. The CPU 2 sends parameters to the DSP 1 in accordance with the operation of the operators on the operating panel 5 and displays the setting state of these operators and the like on the display unit 6.

The operating panel 5 has the operators for the setting of the conditions for the sound field space that is created. The user can set any desired parameters, such as, for example, for the type of room: a small hall, a medium sized hall, or a large hall, for the material of the walls, such as wood, acoustic tile, block, etc., the reverberation time, and the reverberation level.

By setting such parameters, it is possible for the user to create the desired reproduced sound field. In addition, a plurality of these setting states can also be stored in advance as user programs. Accordingly, the operating panel 5 may be equipped with the operators for storing programs as well as operators for the selection and read-out of the desired programs from the plurality of user programs that have been stored.

The remote controller 7 has an operator to select and read out a desired program from the plurality of user programs discussed previously. For example, in a case where the electronic organ and the sound field effect adding apparatus are arranged in places that are separated, it is necessary to select and read out a user program with the player of the electronic organ in a place that is separated from the sound field effect adding apparatus, it is possible to connect the remote controller 7 and carry out the selection operation for a user program in a place that is separated from the sound field effect adding apparatus.

Figure 3:
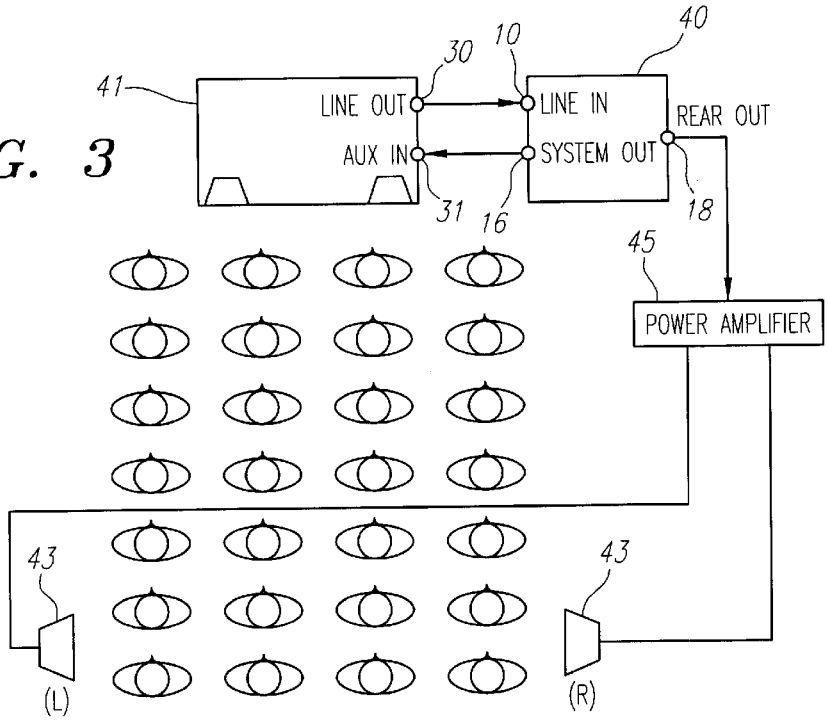
FIG. 3 is a schematic diagram illustrating an example of an audio system used for sound field production to which a sound field effect adding apparatus according to a preferred embodiment has been applied (an example configuration with only a rear speaker system)

The following explanation relates to a structural illustration of an audio system that employs the sound field effect adding apparatus according to the above-described preferred embodiment. FIG. 3 shows an audio system that has been equipped with only a rear speaker system as the multichannel speaker system that is used for sound field generation. This audio system may be suitable for small scale sound field generation (such as for a small hall performance venue).

As is shown in the drawing, an electronic organ 41 may be placed on the stage of the performance venue, and the left and right channel rear speaker system 43 may be arranged in the rear area of the audience. For the speaker system 43, it is not necessary to use speakers having low frequency capabilities and, instead, a relatively low cost speaker system for medium and high range audio frequencies may be employed. However, a speaker system with low frequency capabilities may, of course, also be used for speaker system 43.

The sound field added musical tone signal is supplied from the rear output terminal 18 of the sound field effect adding apparatus 40, to the rear speaker system 43, via the power amplifier 45. In addition, the musical tone signal of the organ audio is supplied to the input terminal 10 of the sound field effect adding apparatus 40, from the output terminal 30 of the electronic organ 41. On the other hand, the sound field added musical tone signal (the low frequency component) that is output from the system output terminal 16 of the sound field effect adding apparatus 40 is supplied to the external input terminal 31 of the electronic organ 41. In the FIG. 3 arrangement, the mixer switch 15 (shown in FIG. 2) of the sound field effect adding apparatus 40 may be set to the ON state, so that a composite signal of the low frequency component of the sound field added musical tone signal and the sound field added musical tone signal for the front is output from the system output terminal 16.

With the FIG. 3 arrangement, the musical tones of the musical tone signal that have been produced by the electronic organ 41 (those that correspond to the so-called direct sounds) are emitted from the speaker system of the electronic organ 41 which has been arranged on the stage in front of the audience. In addition, the sound field added musical tone signal (the composite signal of the low frequency component for the front and the rear and the sound field added musical tone signal for the front) that has been supplied from the sound field effect adding apparatus 40 is added to the above-mentioned musical tone signal and emitted with it. On the other hand, the sound field added musical tone signal for the rear is reproduced by the rear speaker system that has been provided in the rear area of the audience. The low frequency component of this signal may be routed (via the system output 16) to the speakers in the organ placed in front of the audience. By this means, a reproduced sound field that has presence is produced due to the sound field added musical tones from the speaker system of the electronic organ 41 (the composite signal of the low frequency component and the sound field added musical tone signal for the front) and the sound field added musical tones for the rear from the rear speaker system 43.

In this case, the low frequency component of either or both front and rear sound field added musical tone is emitted only from the direction of the electronic organ 41 that has been established in front of the audience. However, since, in general, the audience cannot perceive very well the stereo location of the low frequency musical tones, the reproduction of the sound field sensation is not affected very much, whether the low frequency component tones are emitted from in front of the audience or from the rear of the audience. Therefore, even though the low frequency component is emitted only from in front of the audience, it is possible to provide the audience with a satisfactory sound field effect.

Because, in the audio system of the FIG. 3 embodiment, the rear speaker system may not have the ability to reproduce the low frequencies, there is a danger that low frequency tone components will be produced by those speakers as distortion of the sound due to an excessive input level and the like. Accordingly, in further preferred embodiments, the low frequency component may be eliminated in advance of the rear speakers 43, by passing the sound field added musical tone signal for the rear that is output from the sound field effect adding apparatus through a low-band elimination filter. High-pass filters F1 and F2 are shown in FIG. 1 for this purpose. In this manner, the speakers connected to the front and rear output 17 and 18 may be selected as relatively inexpensive speakers that do not require the ability to produce low frequency tones.

Figure 4:
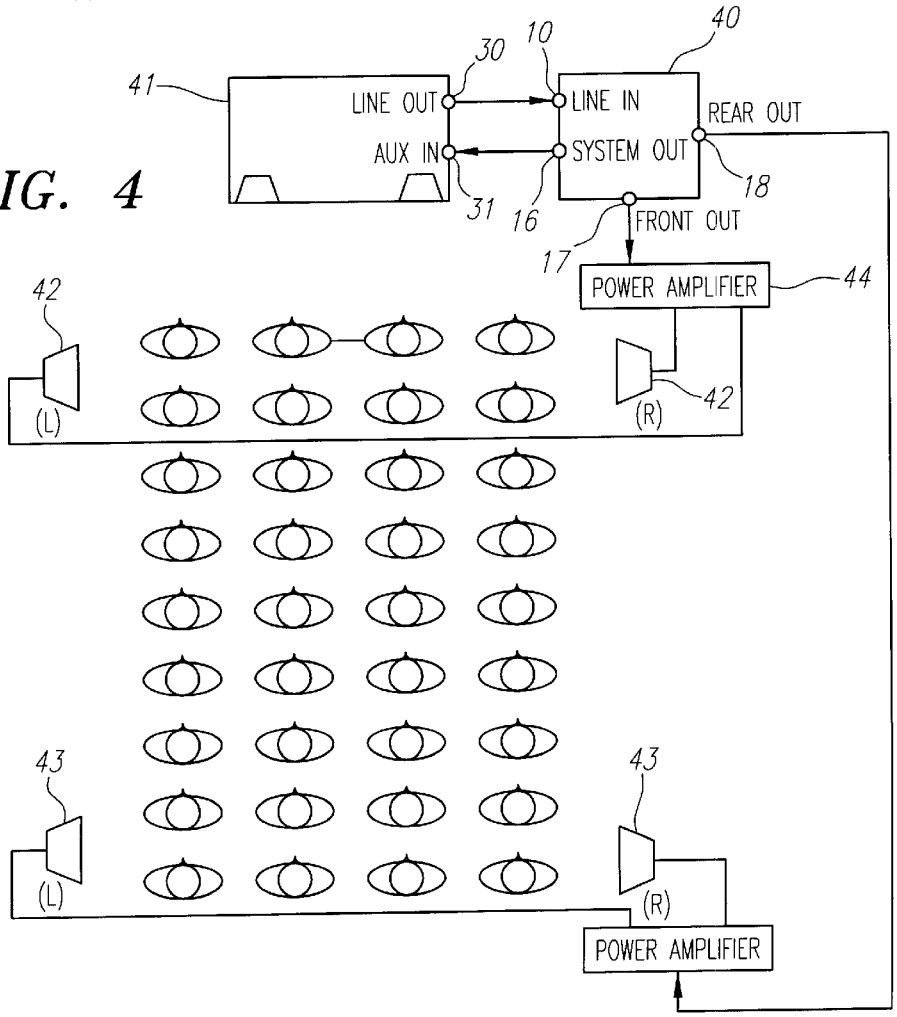
FIG. 4 is a schematic diagram illustrating another audio system used for sound field production to which a sound field effect adding apparatus according to a preferred embodiment has been applied (an example configuration with both front and rear speaker systems).

Another audio system that is used with the sound field effect adding apparatus of the above-described preferred embodiment is shown in FIG. 4. More specifically, FIG. 4 shows an audio system that has been provided with a front speaker system and a rear speaker system as the multichannel speaker system that is used for the production of the sound field. This audio system is suitable for sound field production on a comparatively large scale (sound field production for performance venues such as large halls or medium sized halls, etc.).

As is shown in the drawing, the electronic organ 41 is placed on the stage of the performance venue, the left and right channel front speaker system 42 is arranged in the front area of the audience and the left and right channel rear speaker system 43 is arranged in the rear area of the audience. For these speaker systems 42 and 43, it is not necessary to use speakers having low frequency capabilities and, instead, relatively low cost speaker systems may be employed. However, speaker systems with low frequency capabilities may, of course, also be used for speaker systems 42 and 43.

The sound field added musical tone signal for the front is supplied from the front output terminal 17 of the sound field effect adding apparatus 40 to the front speaker system 42, via the power amplifier 44. The sound field added musical tone signal for the rear is supplied from the rear output terminal 18 of the sound field effect adding apparatus 40 to the rear speaker system 43 via the power amplifier 45. The musical tone signal of the organ audio is supplied from the output terminal 30 of the electronic organ 41 to the input terminal 10 of the sound field effect adding apparatus 40. On the other hand, the sound field added musical tone signal (the low frequency component) that is output from the system output terminal 16 of the sound field effect adding apparatus 40 is supplied to the external input terminal 31 of the electronic organ 41.

In the FIG. 4 arrangement, the mixer switch 15 of the sound field effect adding apparatus 40 may be set to an OFF state, so that only the low frequency component of the sound field added musical tone signal is output from the system output terminal 16. With a system having this structure, the sound field added musical tone signal for the front is reproduced by the front speaker system that is provided in the front area of the audience, while the sound field added musical tone signal for the rear is reproduced by the rear speaker system that is provided in the rear area of the audience.

The musical tones of the musical tone signal that have been produced by the electronic organ 41 are emitted from the speaker system of the electronic organ 41 which has been arranged on the stage in front of the audience. In addition, the low frequency component of the sound field added musical tone signal that has been supplied from the sound field effect adding apparatus 40 is added to the above-mentioned musical tone signal and emitted with it. By this means, a reproduced sound field that has presence is produced, due to the low frequency component of the sound field added musical tones from the speaker system of the electronic organ 41, the sound field added musical tones for the front from the front speaker system, and the sound field added musical tones for the rear from the rear speaker system.

In the configuration of FIG. 4, even though the low frequency component is emitted only from in front of the audience, since the audience cannot fully recognize the stereo location of the low frequency musical tones, it is possible to provide the audience with a satisfactory sound field effect.

Various kinds of modified forms are possible for the preferred embodiments of the present invention. For example, in the preferred embodiment that was discussed above, an electronic organ was employed as the electronic musical instrument with which the musical tone signal is produced. However, further embodiments of the present invention, of course, are not limited to electronic organs and, instead, may employ other kinds of electronic musical instruments, as long as the electronic musical instrument is a type that produces a musical tone signal which includes a low frequency component and has a speaker system with which it is possible to reproduce the low frequency tones for the audio reproduction.

In addition, in the preferred embodiments that are discussed above, the low frequency range was defined as an audio band of around 100 Hz and below. However, the present invention, of course, may be implemented, for example, to handle low frequencies that include such minimum tones as around 50 Hz or below or low tones around 160 Hz or below (or other suitable ranges). What is preferred is that the range of the low frequency be determined in conformance with the general low tone reproduction ability of the speaker system that is used for the sound field generation and that the low frequency band be one that a speaker system that is not made to be used for low frequency reproduction cannot reproduce with good sound quality.

In addition, in preferred embodiments discussed above, the low frequency component that is supplied to the electronic organ from the sound field effect adding apparatus is produced by passing the sound field added musical tone signal from the multichannel reverb section 12 through a low-band-pass filter. However, of course, in the multichannel reverb section 12, the low frequency component may be produced directly based on the musical tone signal that has been input to the apparatus 40 and that has been output from the system output terminal 16.

As has been explained above, in accordance with the present invention, since it is possible to utilize a speaker system of the musical instrument that can reproduce the low frequency tones, as the speaker system for the sound field production, it is possible to create a satisfactory reproduced sound field that achieves a sound field effect by means of a low frequency component without having to provide a dedicated unit that can reproduce the low frequencies as a speaker system for sound field production. Therefore, it is possible to inexpensively construct an audio system that produces a sound field.

What is claimed is:

1. A sound field effect adding apparatus comprising:

an input terminal with which a musical tone of an audio band that includes a low frequency is input;

a first generation means in which a sound field added musical tone signal is generated in order to produce a sound field effect that is based on a musical tone signal that has been input to said input terminal;

a first output terminal for the output of said sound field added musical tone signal to a speaker system used for sound field reproduction;

a second generation means in which a low frequency component of the sound field added musical tone signal that contributes to the production of the sound field effect that is related to the low frequency is generated which is different from the sound field added musical tone signal that is output by said first output terminal;

a second output terminal with which the low frequency component that has been generated in said second generation means is output to an external device; and an electronic musical instrument that is provided with a speaker system with which audio reproduction of audio tones across the audio band including the low frequency is done, wherein an output signal that is output from said second output terminal is supplied to said electronic musical instrument and emitted by the speaker system with which said electronic musical instrument is equipped.

2. The sound field effect adding apparatus of claim 1, further comprising an output setting means in which the sound field added musical tone signal that has been output to a front speaker system from among the speaker systems used for the sound field generation is set so that it is added to the low frequency component that has been generated in said second generation means and is output from said second output terminal to an external device.

3. The sound effect adding apparatus of claim 1, wherein a high-pass filter is connected in series with the first output terminal.

4. An audio system for use with an electronic musical instrument, comprising:

a sound field effect adding apparatus having:

an input terminal with which a musical tone of an audio band that includes a low frequency is input, a first generation means, in which a sound field added musical tone signal is generated in order to produce a sound field effect that is based on a musical tone signal that has been input to said input terminal, a first output terminal for the output of said sound field added musical tone signal to a speaker system used for sound field reproduction, a second generation means in which a low frequency component of the sound field added musical tone signal that contributes to the production of the sound field effect that is related to the low frequency is generated which is different from the sound field added musical tone signal that is output by said first output terminal, and a second output terminal with which the low frequency component that has been generated in said second generation means is output to an external device;

an electronic musical instrument that is provided with a speaker system with which audio reproduction of audio tones across the audio band including the low frequency is done; and a speaker system used for sound field generation;

wherein the musical tone signal that is generated by said electronic musical instrument is supplied to the input terminal of said sound field effect adding apparatus;

wherein the sound field added musical tone signal that is output from the first output terminal of said sound field effect adding apparatus is supplied to said speaker system used for the production of the sound field, and wherein an output signal that is output from said second output terminal is supplied to said electronic musical instrument and emitted by the speaker system with which said electronic musical instrument is equipped.

5. The audio system of claim 4, further comprising an output setting means in which the sound field added musical tone signal that has been output to a front speaker system from among the speaker systems used for the sound field generation is set so that it is added to the low frequency component that has been generated in said second generation means and is output from said second output terminal to an external device.

6. An audio system of claim 4, wherein a high-pass filter is connected in series with the first output terminal.

7. A process of adding a sound field effect comprising:

receiving, at an input terminal, a musical tone of an audio band that includes a low frequency;

generating a sound field added musical tone signal in order to produce a sound field effect that is based on a musical tone signal that has been received at said input terminal;

producing, at a first output terminal, the output of said sound field added musical tone signal;

providing the output at first output terminal to a speaker system used for sound field reproduction;

generating a low frequency component of the sound field added musical tone signal that contributes to the production of the sound field effect that is related to the low frequency, which is different from the sound field added musical tone signal that is output by said first output terminal; and producing, at a second output terminal, the low frequency component that has been generated in said second generation means;

providing the output at the second output terminal to an external device; and providing an electronic musical instrument that is provided with a speaker system with which audio reproduction of audio tones across the audio band including the low frequency is done, wherein an output signal that is output from said second output terminal is supplied to said electronic musical instrument and emitted by the speaker system with which said electronic musical instrument is equipped.

8. The process of claim 7, further comprising setting an output setting means in which the sound field added musical tone signal that has been output to a front speaker system from among the speaker systems used for the sound field generation is added to the low frequency component that has been generated in said second generation means and is output from said second output terminal to an external device.

9. A process as in claim 7, further comprising providing a high-pass filter in series with the first output terminal.

* * * * *